US008168906B2

(12) United States Patent
Liu

(10) Patent No.: US 8,168,906 B2
(45) Date of Patent: May 1, 2012

(54) SUPPORT MEMBER, KEYSWITCH, AND KEYBOARD

(75) Inventor: Chia-Hung Liu, Zhongli (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 327 days.

(21) Appl. No.: 12/622,414

(22) Filed: Nov. 19, 2009

(65) Prior Publication Data

US 2010/0122896 A1 May 20, 2010

(30) Foreign Application Priority Data

Nov. 20, 2008 (TW) ..... 97144870 A

(51) Int. Cl.
*H01H 13/70* (2006.01)

(52) U.S. Cl. ..... 200/344

(58) Field of Classification Search ..... 200/5 A, 200/341, 344, 345; 29/622; 400/490–496; 341/22; 345/168, 169
See application file for complete search history.

(56) References Cited

U.S. PATENT DOCUMENTS

| | | | | |
|---|---|---|---|---|
| 4,856,189 | A * | 8/1989 | Liao | 29/882 |
| 5,076,426 | A * | 12/1991 | Thomas | 206/717 |
| 6,072,133 | A * | 6/2000 | Takagi et al. | 200/344 |
| 6,392,176 | B1 * | 5/2002 | Tsai | 200/344 |
| 6,444,933 | B1 * | 9/2002 | Chun | 200/344 |
| 7,882,609 | B2 * | 2/2011 | Hsu et al. | 29/436 |
| 8,053,697 | B2 * | 11/2011 | Lin | 200/344 |
| 2001/0046403 | A1 * | 11/2001 | Shih-Hsin | 400/495 |
| 2002/0096424 | A1 * | 7/2002 | Chun | 200/344 |
| 2006/0049031 | A1 * | 3/2006 | Lee et al. | 200/344 |

* cited by examiner

*Primary Examiner* — Michael Friedhofer
(74) *Attorney, Agent, or Firm* — Winston Hsu; Scott Margo

(57) ABSTRACT

A support member for supporting a key cap, a keyswitch and a keyboard with the support structure are disclosed. The support member includes a first subunit and a second subunit. The first subunit includes a first arm which includes a first pivoting part at one end. The second subunit includes a third pivoting part connected to the first pivoting part temporarily. Therein, a second arm and a third arm are bended to extend from two ends of the third pivoting part respectively. There is a second position structure at an end of the second arm, and there is a third position structure at an end of the third arm. The second position structure and the third position structure can be connected to two first position structures on a base plate respectively. The distance between the second position structure and the position fixing structure is longer than that between the two first position structures.

24 Claims, 9 Drawing Sheets

SUPPORT MEMBER, KEYSWITCH, AND KEYBOARD

BACKGROUND OF THE INVENTION

1. Field of the Invention

This invention relates to a support member and a keyswitch and a keyboard using the support member.

2. Description of the Prior Art

In general, the operation of a keyswitch on a keyboard is that a user presses the keycap of the keyswitch to trigger a switch to send a signal to a processor and then the user stops pressing so that a resilient force produced by a resilient member under the key cap pushes the key cap back to its original position. Therein, a support member is connected to and between the key cap and a base plate of the keyboard respectively, so that the return position of the key cap will not deviate from the original position because of the pressing.

In the prior art, the support member usually is a scissors-shaped structure; that is, the support member consists of at least two components. An end of each of the components is pivotally connected to the key cap, and the other end of each of the components is pivotally connected to the base plate. Furthermore, the middle portions of the two components are pivotally connected. By the pivotally-connected middle portions, the two components could rotate relatively so that the key cap is able to vertical move relative to the base plate.

However, the two components of the present support member of the keyswitch of the keyboard are formed by injection through different molds respectively. In the assembly, the two components are drawn from the molds respectively and then assembled. Therefore, there is much labor power brought in the assembly of the support member, and it leads to the increment of the production cost.

SUMMARY OF THE INVENTION

Accordingly, a scope of the invention is to provide a new type of support member. Two subunits of the support member could be formed in one piece by common-mold injection or other methods, which reduces the complexity of the assembly to solve the above problems.

The support member of the invention is used for supporting a key cap of a keyswitch to vertically move relative to a base plate of the keyswitch. Two first position structures are disposed oppositely on the base plate. According to an embodiment, the support member of the invention includes a first subunit and a second subunit. The first subunit includes a first arm which includes a first rotation structure. A first pivoting part and a second pivoting part are bended to extend from two ends of the first arm respectively.

Furthermore, the second subunit includes a third pivoting part temporarily connected to the first pivoting part. A second arm and a third arm are bended to extend from two ends of the third pivoting part respectively. The second arm includes a second rotation structure pivotally connected to the first rotation structure. The second arm also includes a second position structure at an end thereof. The third arm includes a third position structure at one end thereof corresponding to the second position structure. In particular, the distance between the second position structure and the third position structure is longer than the distance between the two first position structures.

When the keyswitch is assembled, the second pivoting part and the third pivoting part are movably connected to the key cap, and the third pivoting part and the first pivoting part are separated, so that the first subunit and the second subunit are able to rotate relatively around an axis of the first rotation structure and the second rotation structure. The first pivoting part is movably connected to the base plate. The second position structure and the third position structure are movably connected to the two first position structures respectively.

Another scope of the invention is to provide a keyswitch using the above support member.

According to an embodiment, the keyswitch of the invention includes a base plate, a key cap, and a support member. The base plate includes two first position structures disposed oppositely thereon. The key cap is disposed above the base plate. The support member is disposed between the base plate and the key cap for supporting the key cap to vertically move relative to the base plate.

The support member includes a firs subunit and a second subunit. The first subunit includes a first arm which includes a first rotation structure. A first pivoting part and a second pivoting part are bended to extend from two ends of the first arm respectively.

The second subunit includes a third pivoting part temporarily connected to the first pivoting part. A second arm and a third arm are bended to extend from two ends of the third pivoting part respectively. The second arm includes a second rotation structure pivotally connected to the first rotation structure. The second arm also includes a second position structure at an end thereof. The third arm includes a third position structure at one end thereof corresponding to the second position structure. In particular, the distance between the second position structure and the third position structure is longer than the distance between the two first position structures.

When the keyswitch is assembled, the second pivoting part and the third pivoting part are movably connected to the key cap, and the third pivoting part and the first pivoting part are separated, so that the first subunit and the second subunit are able to rotate relatively around an axis of the first rotation structure and the second rotation structure. The first pivoting part is movably connected to the base plate. The second position structure and the third position structure are movably connected to the two first position structures respectively.

Another scope of the invention is to provide a keyboard using the above keyswitch.

According to an embodiment, the keyboard of the invention includes a base plate, a plurality of key caps, and a plurality of support members. The key caps are disposed above the base plate. The support members are disposed between the base plate and the key caps correspondingly for supporting the corresponding key cap to vertically move relative to the base plate.

In this embodiment, each of the support members includes a first subunit and a second subunit. The first subunit includes a first arm which includes a first rotation structure. A first pivoting part and a second pivoting part are bended to extend from two ends of the first arm respectively.

Furthermore, the second subunit includes a third pivoting part temporarily connected to the first pivoting part. A second arm and a third arm are bended to extend from two ends of the third pivoting part respectively. The second arm includes a second rotation structure pivotally connected to the first rotation structure. The second arm also includes a second position structure at an end thereof. The third arm includes a third position structure at one end thereof corresponding to the second position structure. The distance between the second position structure and the third position structure is longer than the distance between the two first position structures.

When the keyboard is assembled, the second pivoting part and the third pivoting part are movably connected to the key cap, and the third pivoting part and the first pivoting part are separated, so that the first subunit and the second subunit are able to rotate relatively around an axis of the first rotation structure and the second rotation structure. The first pivoting part is movably connected to the base plate. The second position structure and the third position structure are movably connected to the two first position structures respectively.

Compared with the prior art, the two subunits of the support member of the invention could be made by common-mold injection. The two subunits could be automatically separated in the assembly through the special design on the key cap or the base plate. Therefore, the invention has the advantages of convenience and quickness in assembly. Furthermore, the damage to the support member or the keyswitch in the process of manual assembly could be reduced by the design of the invention.

The advantage and spirit of the invention may be understood by the following recitations together with the appended drawings.

BRIEF DESCRIPTION OF THE APPENDED DRAWINGS

DETAILED DESCRIPTION OF THE INVENTION

The invention provides a support member and a keyswitch and a keyboard using the support member. In particular, the invention provides a new type support member and a keyswitch and a keyboard using the support member.

Figure 1A:
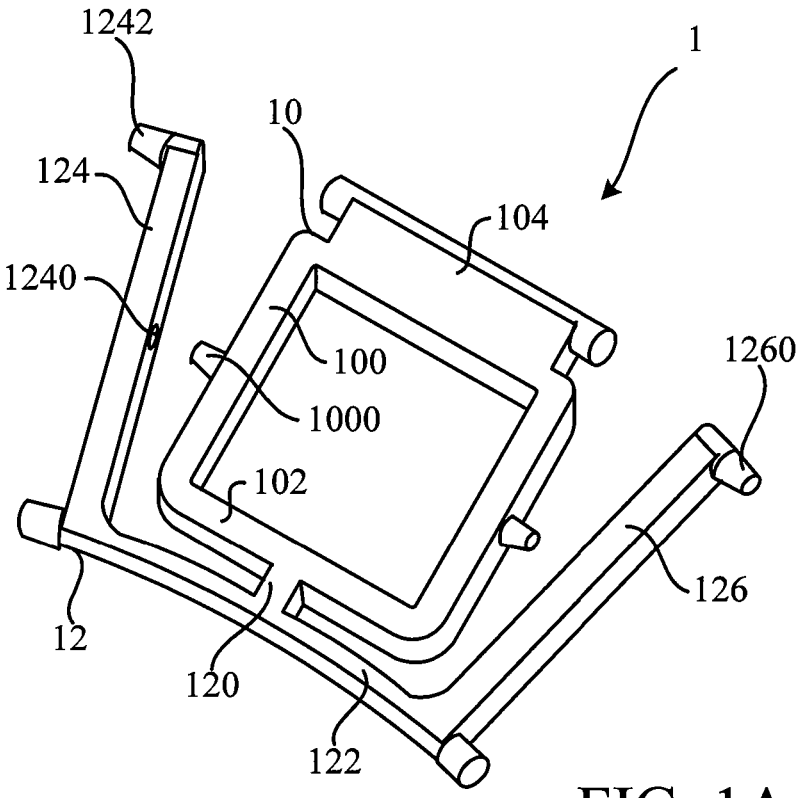
FIG. 1A is a schematic diagram illustrating a support member according to an embodiment of the invention.
Figure 1B:
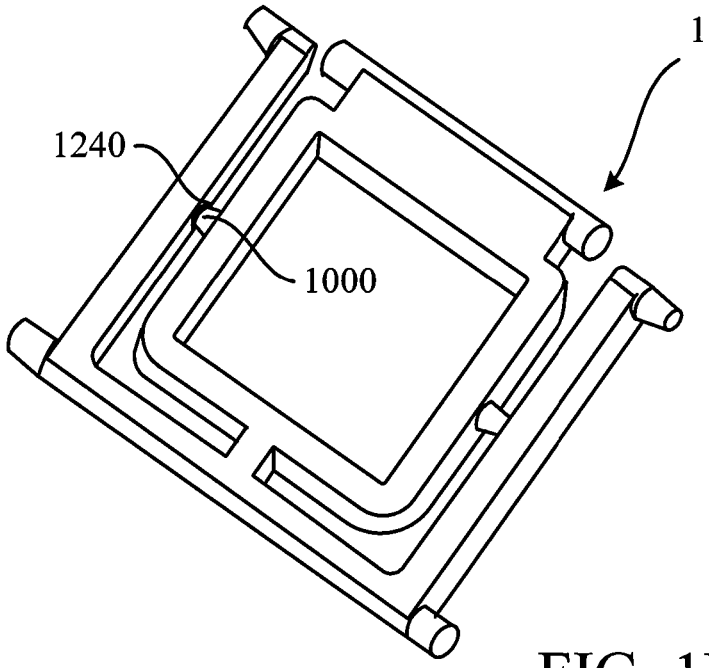
FIG. 1B is a schematic diagram illustrating the support member in FIG. 1A pressed by an external force.
Figure 2A:
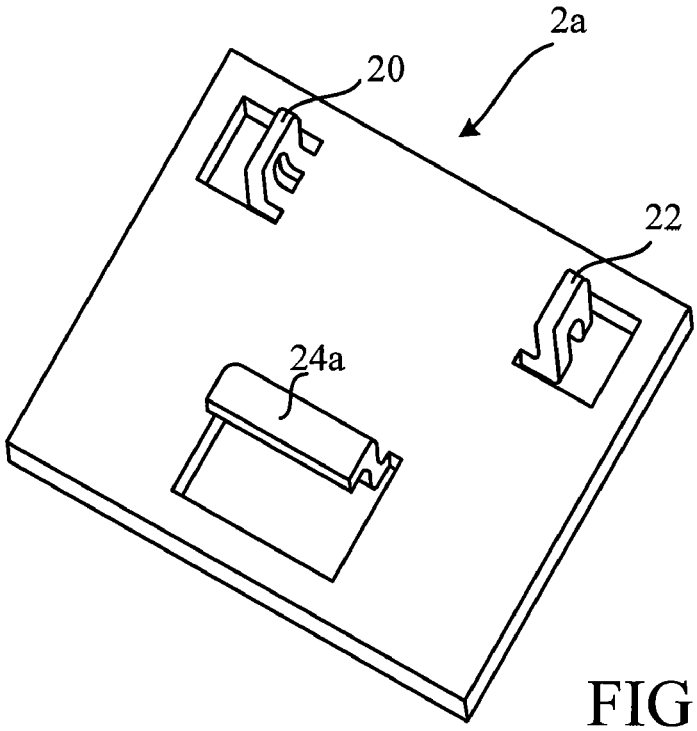
FIG. 2A is a schematic diagram illustrating a base plate of the support member in FIG. 1A.
Figure 2B:
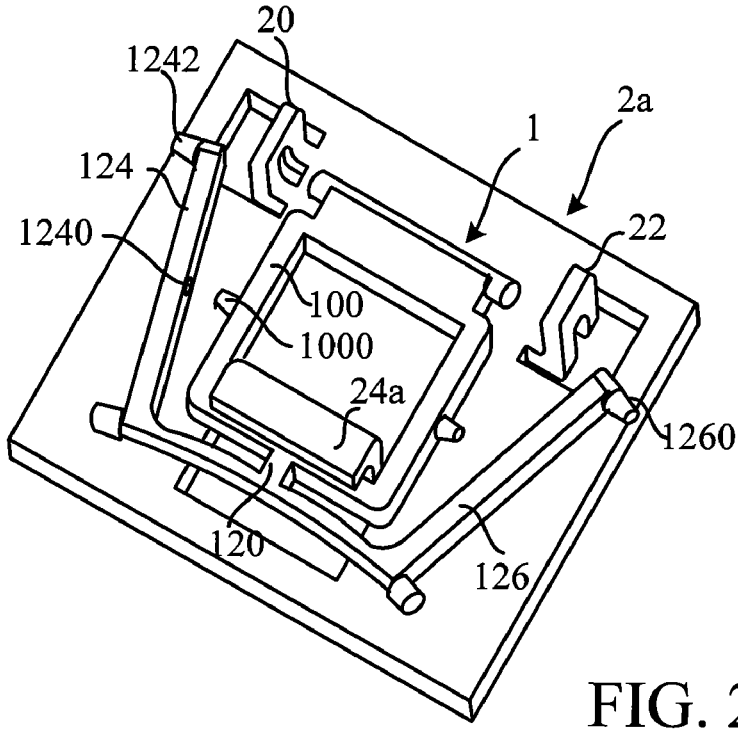
FIGS. 2B through 2D are schematic diagrams illustrating the assembly of the support member in FIG. 1A and the base plate in FIG. 2A.
Figure 2C:
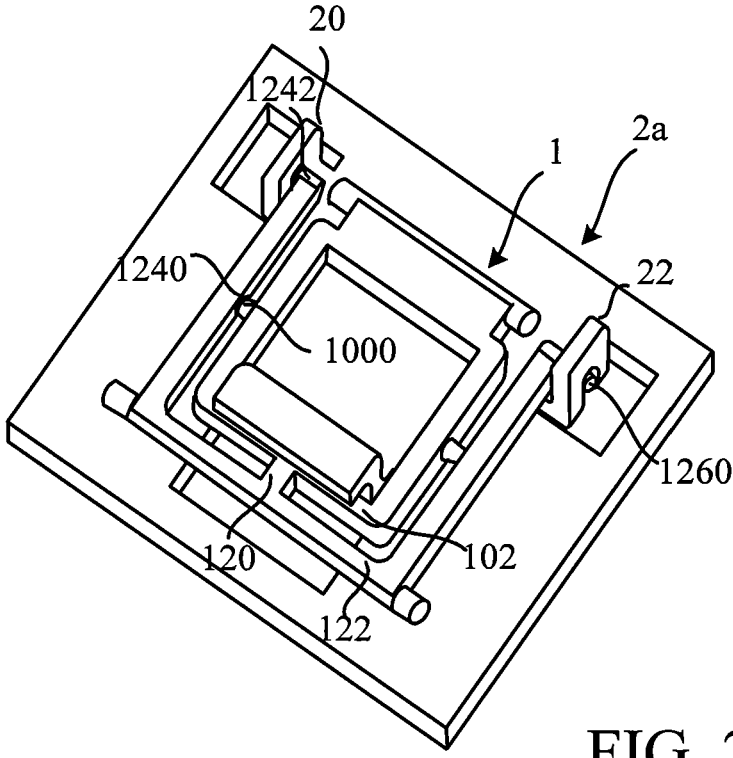
Figure 2D:
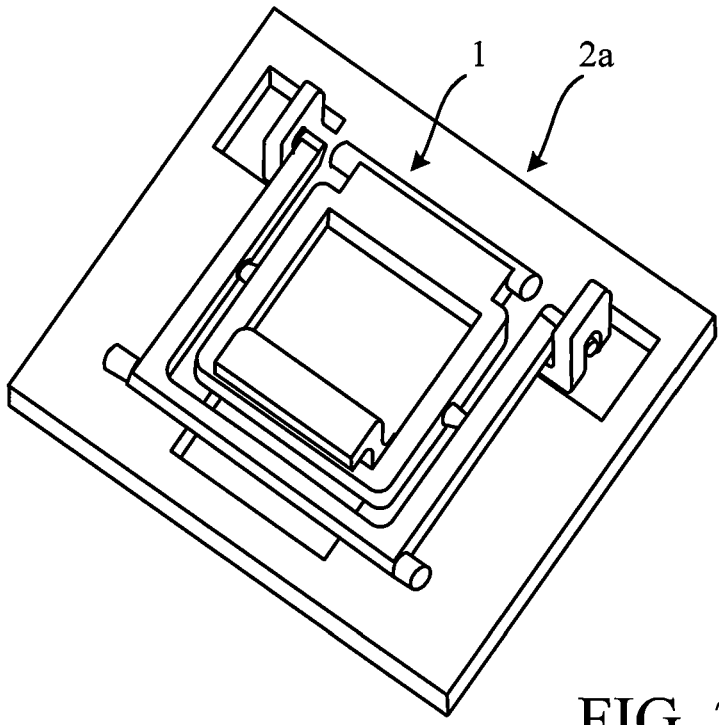

Please refer to FIGS. 1A, 1B and 2A through 2D. FIG. 1A is a schematic diagram illustrating a support member 1 according to an embodiment of the invention. FIG. 1B is a schematic diagram illustrating the support member 1 in FIG. 1A pressed by an external force. FIG. 2A is a schematic diagram illustrating a base plate 2*a* of the support member 1 in FIG. 1A. FIGS. 2B through 2D are schematic diagrams illustrating the assembly of the support member 1 in FIG. 1A and the base plate 2*a* in FIG. 2A.

As shown in FIG. 1A, the support member 1 includes a first subunit 10 and a second subunit 12. The first subunit 10 and the second subunit 12 could be made by common-mold injection. The first subunit 10 includes a first arm 100 which includes a first rotation structure 1000. In this embodiment, the first rotation structure 1000 is a shaft. Furthermore, a first pivoting part 102 and a second pivoting part 104 are bended to extend from two ends of the first arm 100 respectively.

In this embodiment, the second subunit 12 includes a third pivoting part 122 temporarily connected to the first pivoting part 102 of the first subunit 10 through a connection part 120. A second arm 124 and a third arm 126 are bended to extend from two ends of the third pivoting part 122 respectively. Therein, the second arm 124 and the third arm 126 respectively includes a second rotation structure 1240 which is a shaft hole in this embodiment and is pivotally connected to the first rotation structure 1000. Furthermore, the second arm 124 also includes a second position structure 1242 at an end thereof; the third arm 126 includes a third position structure 1260 at one end thereof corresponding to the second position structure 1242.

As shown in FIG. 2A, the base plate 2*a* includes a slide slot 24*a* and two first position structures 20 and 22. In particular, the distance between the second position structure 1242 and the third position structure 1260 is longer than the distance between the two first position structures 20 and 22 on the base plate 2*a* in FIG. 2A.

The second subunit 12 is made of resilient material, and the resilient material could be polyoxymethylene (POM) or other proper resilient material. Therefore, a proper force could be loaded on the second subunit 12 to bend. As shown FIG. 1B, when forces are loaded towards the first arm 100 on the second arm 124 and the third arm 126 of the second subunit 12 respectively, the second arm 124 and the third arm 126 move towards the first arm 100. At this time, the first rotation structure 1000 is pivotally connected to the second rotation structure 1240. Of course, in practical applications, the first subunit 10 could also be made of POM or other resilient material.

In addition, as shown in the figures, the second subunit 12 in the embodiment is U-shaped. In practical applications, the profile of the second subunit 12 depends on the request of a user or a designer, not limited to the embodiments cited in this specification.

In the assembly of the support member onto the base plate 2*a*, the first pivoting part 102 slides into the slide slot 24*a* first, and the second arm 124 and the third arm 126 are still wide open spread at this time, as shown in FIG. 2B. Then, forces are loaded towards the first arm 100 on the second arm 124 and the third arm 126, so that the second arm 124 and the third arm 126 move close to the first arm 100. The second position structure 1242 and the third position structure 1260 are horizontally assembled to the first position structures 20 and 22 of the base plate 2*a*, and the first rotation structure 1000 is pivotally connected to the second rotation structure 1240, as shown in FIG. 2C. It is noticed that the resilient force of the second arm 124 and the third arm 126 could make the engagement thereof with the first position structures 20 and 22 firmer.

Further, the temporary connection part 120 temporarily connecting the first pivoting part 102 and the third pivoting part 122 is removed so that the first subunit 10 and the second subunit 12 are separated, as shown in FIG. 2D. Thereby, the first subunit 10 and the second subunit 12 are able to rotate relatively around an axis of the first rotation structure 1000 and the second rotation structure 1240 so as to support the key cap (not shown in the figures) of the keyswitch to vertically move relative to the base plate 2*a*.

Figure 3A:
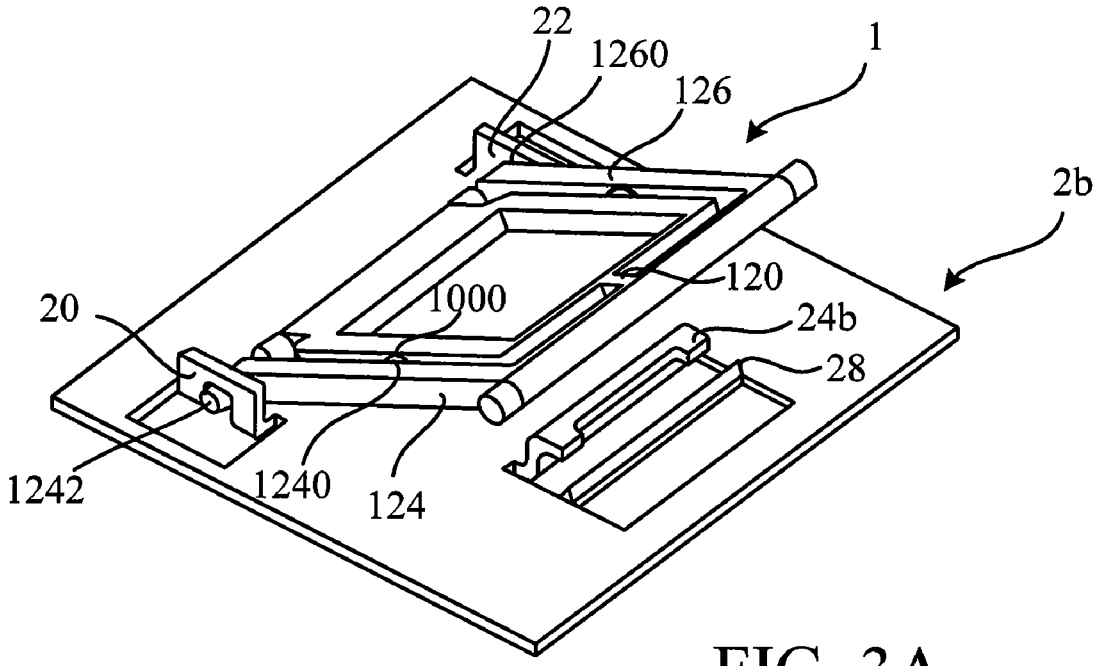
FIGS. 3A and 3B are schematic diagrams illustrating another assembly of the support member in FIG. 1A and the base plate.
Figure 3B:
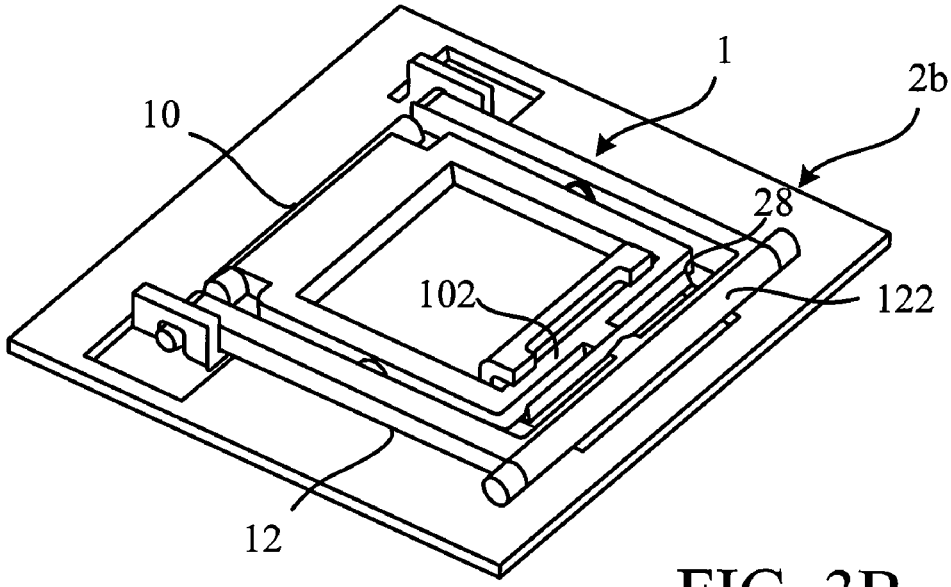

Please refer to FIGS. 3A and 3B. FIGS. 3A and 3B are schematic diagrams illustrating another assembly of the support member 1 in FIG. 1A and the base plate 2*b*. It is different to the base plate 2*a* in FIGS. 2A through 2D that the top of the slide slot 24*b* of the base plate 2*b* herein dents slightly. By the slight change in structure, the assembly of the support member 1 and the base plate 2*b* could be easier. Furthermore, the base plate 2*b* includes a protrusion 28 near the slide slot 24*b* additionally.

As shown in FIGS. 3A and 3B, in the assembly, the second position structure 1242 and the third position structure 1260 are horizontally assembled to the first position structures 20 and 22 of the base plate 2*b*, and the first rotation structure 1000 is pivotally connected to the second rotation structure 1240. As above-mentioned, the resilient force of the second arm 124 and the third arm 126 could make the engagement thereof with the first position structures 20 and 22 firmer. Then, by regarding the second position structure 1242 and the third position structure 1260 as the rotation pivot, the first pivoting part 102 of the first subunit 10 slide into the slide slot 24*b*. The protrusion 28 could be disposed at a place corresponding to the temporary connection part 120, so that the temporary connection part 120 could be cut off by the protrusion 28 in the assembly, and the first subunit 10 and the second subunit 12 are separated. The assembly of the support member 1 and the base plate 2*b* is therefore completed.

In practical applications, the protrusion could be disposed at the bottom of the key cap so as to fracture the connection part 120 when the key cap is assembled to the support member 1, and the third pivoting part 122 and the first pivoting part 102 are therefore separated. It is noticed that the method of removing the temporary connection 120 is not limited to the above embodiments, and any reasonable variant is also in the scope of the invention.

Figure 4:
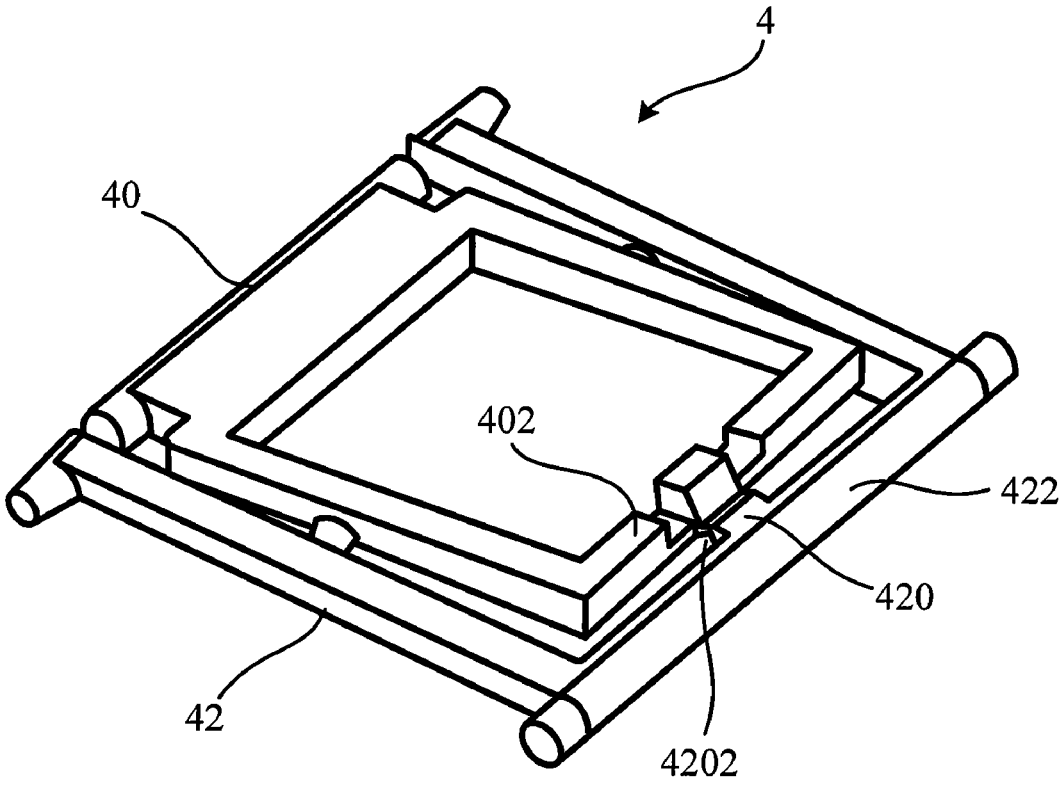
FIG. 4 is a schematic diagram illustrating the support member according to another embodiment of the invention.

Please refer to FIG. 4. FIG. 4 is a schematic diagram illustrating the support member 4 according to another embodiment of the invention. As shown in FIG. 4, the support member 4 disclosed in this embodiment includes a first subunit 40 and a second subunit 42. Similarly, the third pivoting part 422 of the second subunit 42 is temporarily connected to the first pivoting part 402 of the first subunit 40.

In particular, the connection part 420 has a pre-cut portion 4202 formed thereon. The thickness of the pre-cut 4202 is thinner. Therefore, when the support member 4 is assembled to the base plate, a worker could press the pre-cut portion 4202 by hand or a fixture, so that the connection part 420 breaks at the pre-cut portion 4202 and the third pivoting part 422 and the first pivoting part 402 are therefore separated. Furthermore, as shown in FIG. 4, the first subunit 40 and the second subunit 42 are not coplanar, and it is conducive to the execution of pressing the pre-cut portion 4202.

Figure 5A:
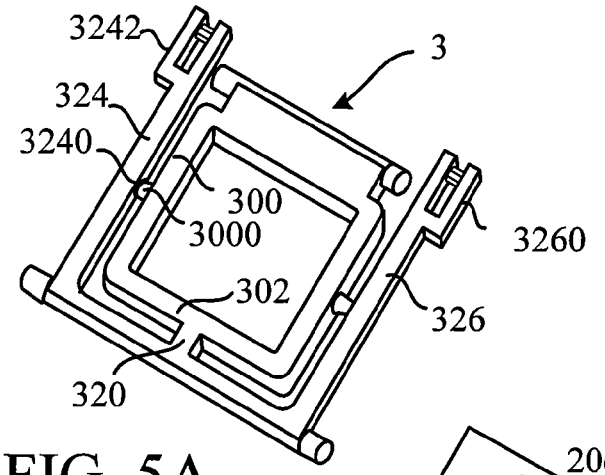
FIGS. 5A through 5C are schematic diagrams illustrating the assembly of the support member and the base plate according to another embodiment of the invention.
Figure 5B:
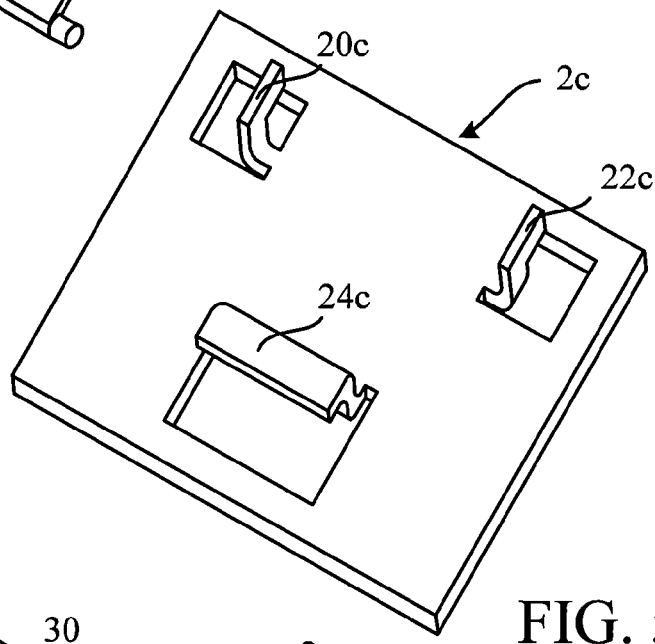
Figure 5C:
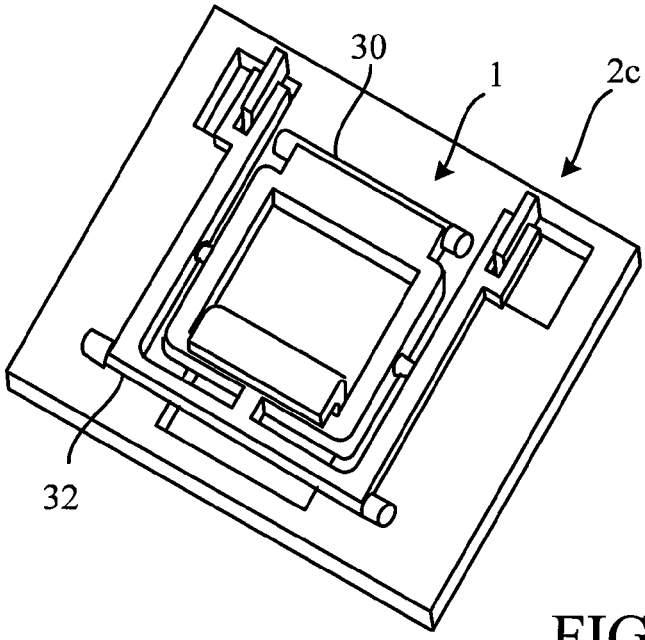

Please refer to FIGS. 5A through 5C. FIGS. 5A through 5C are schematic diagrams illustrating the assembly of the support member 3 and the base plate 2*c* according to another embodiment of the invention. It is different to the support member 1 shown in FIGS. 1A and 1B that the second position structure 3242 and the third position structure 3260 of the support member 3 respectively are branched into two branches which a rod connects therebetween. Furthermore, the first position structures 20*c* and 22*c* of the base plate 2*c* in the embodiment are open-end structures with openings for movably engaging with the rod.

The assembly of the support member 3 and the base plate 2*c* in the embodiment is substantially the same as the assembly shown in FIGS. 2B through 2D. In the assembly, forces are loaded on the second arm 324 and the third arm 326 towards the first arm 300 first, and the second arm 324 and the third arm 326 therefore move close to the first arm 300, so that the first rotation structure 3000 and the second rotation structure 3240 are pivotally connected. The first pivoting part 302 then slides into the slide slot 24*c*. Afterwards, the second position structure 3242 and the third position structure 3260 are from top to bottom vertically assembled to the first position structures 20*c* and 22*c* of the base plate 2*c*. At last, the temporary connection part 320 is cut off by the above methods, so that the first subunit 30 and the second subunit 32 are separated.

Figure 6A:
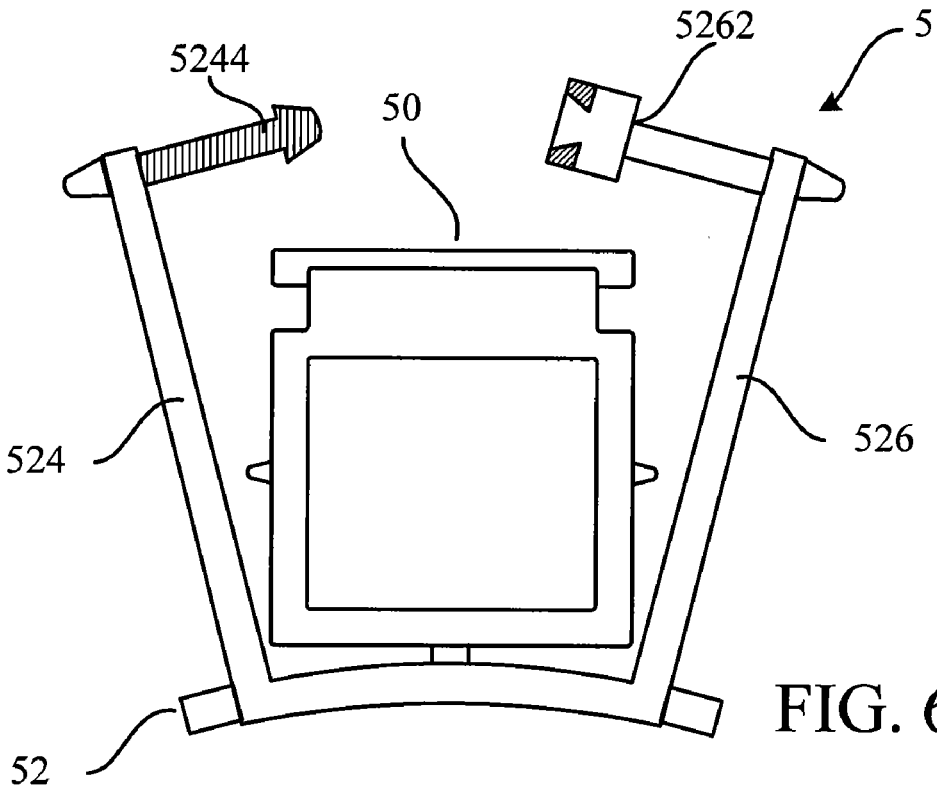
FIG. 6 is a schematic diagram illustrating the support member according to an embodiment of the invention.
Figure 6B:
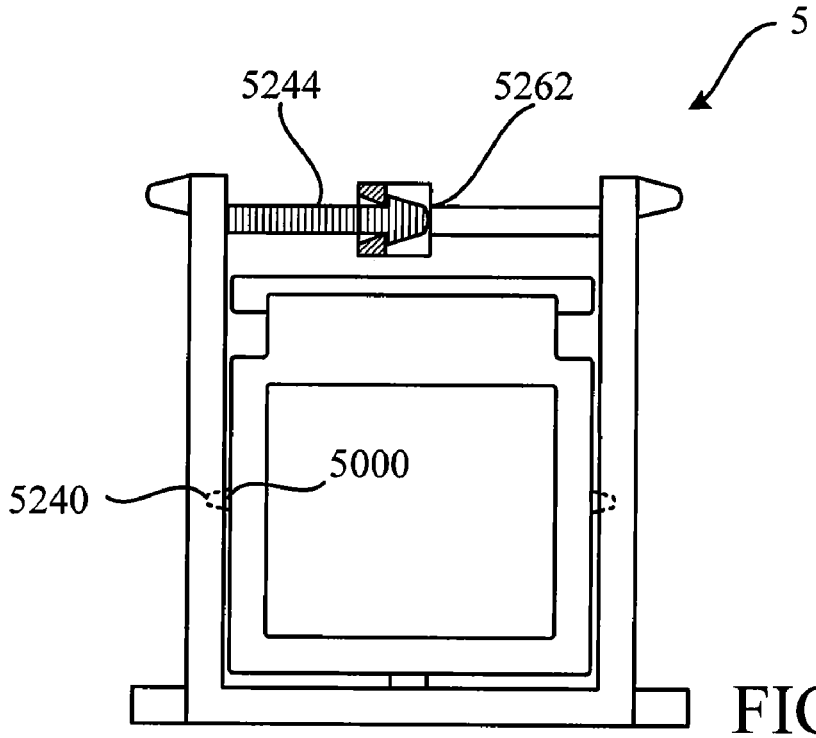

Please refer to FIG. 6. FIG. 6 is a schematic diagram illustrating the support member 5 according to an embodiment of the invention. As shown in FIG. 6, the support member 5 in the embodiment is substantially the same as the support members 1 and 3 mentioned above. The difference is that a first engagement part 5244 is formed on the second arm 524 and a second engagement part 5262 is formed on the third arm 526 in order to enhance the strength of the second subunit 52. Thereby, when the keyswitch is assembled, the first rotation structure 5000 of the first subunit 50 and the second rotation structure 5240 of the second subunit 52 are pivotally connected and the first engagement part 5244 is engaged with the second engagement part 5262 firmly.

Figure 7:
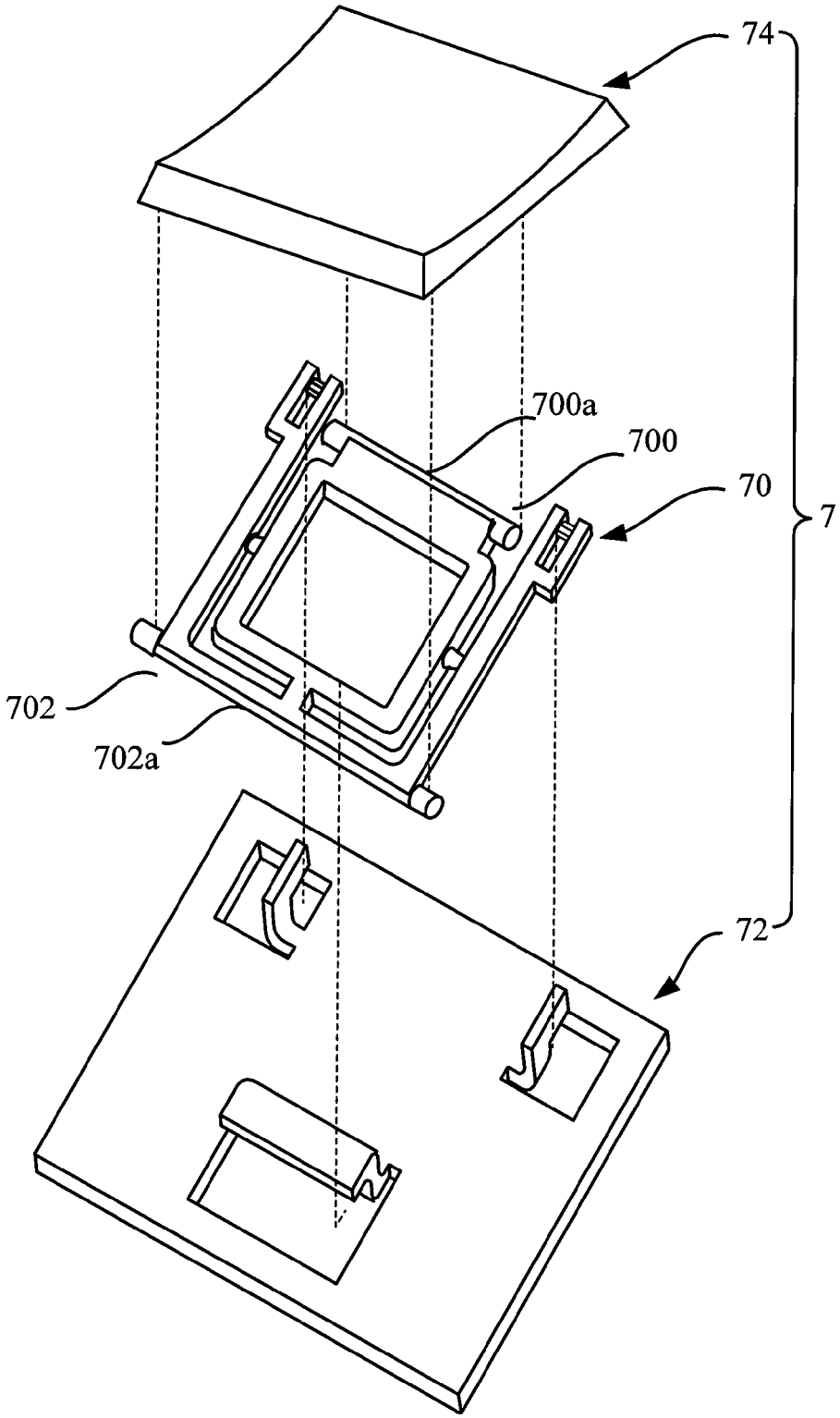
FIG. 7 is an exploded view of the keyswitch according to an embodiment of the invention.

Please refer to FIG. 7. FIG. 7 is an exploded view of the keyswitch 7 according to an embodiment of the invention. As shown in FIG. 7, the keyswitch 7 includes the support member 70, the base plate 72, and the key cap 74 mentioned above. The structure and the assembly method of the support member 70 and the base plate 72 are the same as discussed above and will not be described more. In addition, the key cap 74 is disposed above the base plate 72 and the support member 70. When the keyswitch 7 is assembled, the second pivoting part 700*a* of the first subunit 700 and the third pivoting part 702*a* of the second subunit 702 of the support member 70 are movably connected to the bottom of the key cap 74. Thereby, the support member 70 could support the key cap 74 to vertically move relative to the base plate 72.

The invention also provides a keyboard with the above keyswitch.

Figure 8:
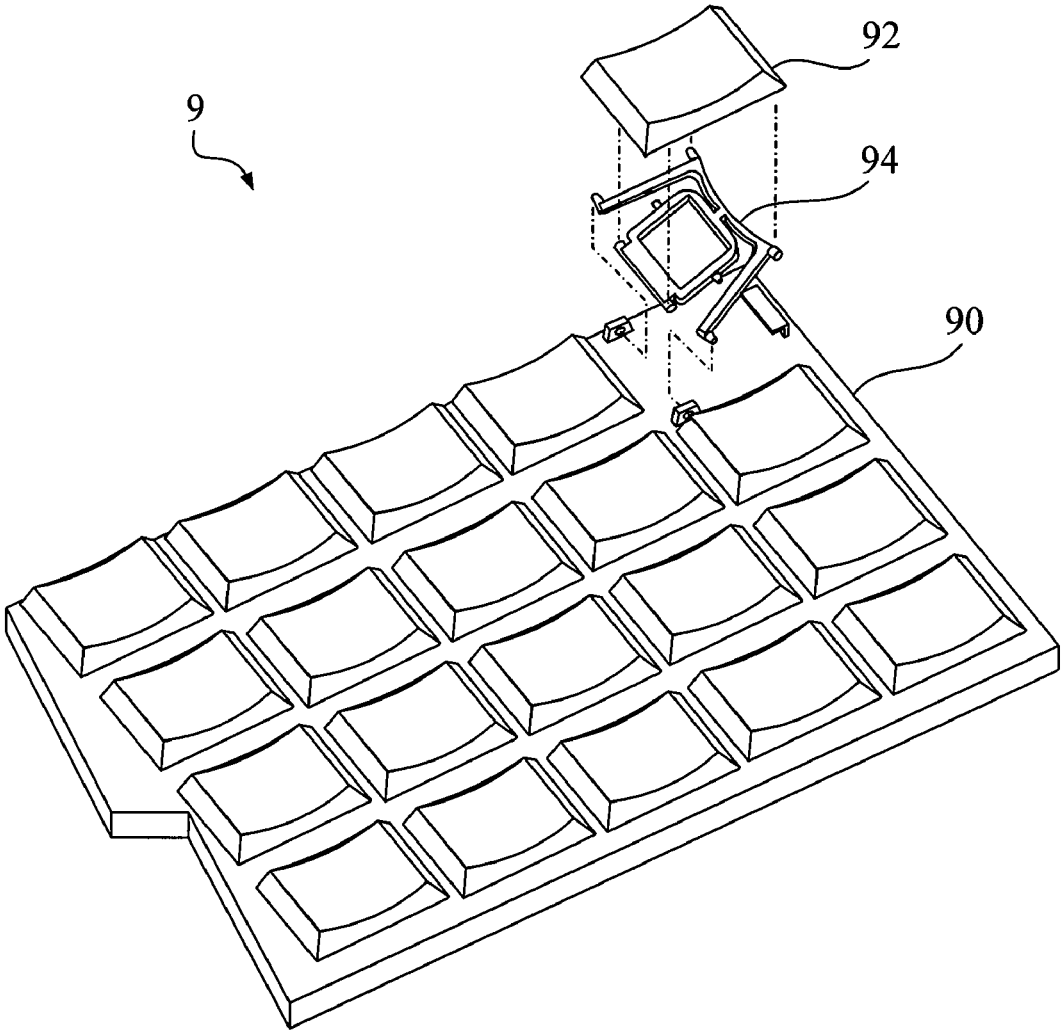
FIG. 8 is a schematic diagram illustrating a keyboard according to an embodiment of the invention.

Please refer to FIG. 8. FIG. 8 is a schematic diagram illustrating a keyboard 9 according to an embodiment of the invention. As shown in FIG. 8, the keyboard 9 includes a base plate 90, a plurality of key caps 92, and a plurality of support members 94. The support members 94 are disposed between the key caps 92 and the base plate 90 correspondingly for supporting the corresponding key cap 92 to vertically move relative to the base plate 90. The structure and the assembly method of the supporting member 94, the base plate 90, and the key cap 90 are the same as discussed above and will not be described more.

Compared with the prior art, the support member in the prior art includes at least two components which are formed by injection through different molds respectively, and in the assembly, the two components are need to be drawn from the molds respectively and then assembled. Therefore, there is much labor power brought in the assembly of the support member, and it leads to the increment of the production cost. Because the two subunits of the support member of the invention are made by common-mold injection, the support member is a single structure with two inner and outer units. The two inner and outer units could be separated in the assembly through the special design on the key cap or the base plate, so the invention has the advantages of convenience and quickness in assembly. Furthermore, the damage to the support member or the keyswitch in the process of manual assembly could be reduced by the design of the invention.

With the example and explanations above, the features and spirits of the invention will be hopefully well described. Those skilled in the art will readily observe that numerous modifications and alterations of the device may be made while retaining the features and spirit of the invention.

Accordingly, the above disclosure should be construed as limited only by the metes and bounds of the appended claims.

What is claimed is:

1. A support member, for supporting a key cap of a keyswitch to vertically move relative to a base plate of the keyswitch, two first position structures being disposed oppositely on the base plate, the support member comprising:

a first subunit, comprising a first arm, the first arm comprising a first rotation structure, a first pivoting part and a second pivoting part being bended to extend from two ends of the first arm respectively; and a second subunit, comprising a third pivoting part temporarily connected to the first pivoting part through a connection part, the connection part comprising a pre-cut portion, the connection part breaking at the pre-cut portion under a loading of an external force so that the third pivoting part and the first pivoting part are separated when the keyswitch is assembled, the second subunit further comprising a second arm and a third arm being bended to extend from two ends of the third pivoting part respectively, the second arm comprising a second rotation structure pivotally connected to the first rotation structure, wherein the second arm comprises a second position structure at an end thereof, the third arm comprises a third position structure at one end thereof corresponding to the second position structure, and a distance between the second position structure and the third position structure is longer than a distance between the two first position structures;

wherein when the keyswitch is assembled, the second pivoting part and the third pivoting part are movably connected to the key cap, the third pivoting part and the first pivoting part are separated, so that the first subunit and the second subunit are able to rotate relatively around an axis of the first rotation structure and the second rotation structure, the first pivoting part is movably connected to the base plate, and the second position structure and the third position structure are movably connected to the two first position structures respectively.

2. The support member of claim 1, wherein the second subunit is made of resilient material.

3. The support member of claim 2, wherein the resilient material is polyoxymethylene.

4. The support member of claim 1, wherein the second subunit is U-shaped.

5. The support member of claim 1, wherein the second arm comprises a first engagement part, the third comprises a second engagement part, and when the keyswitch is assembled, the first engagement part is engaged to the second engagement part firmly.

6. The support member of claim 1, wherein the base plate comprises a protrusion for fracturing the connection part when the keyswitch is assembled, so that the third pivoting part and the first pivoting part are separated.

7. The support member of claim 1, wherein the key cap comprises a protrusion for fracturing the connection part when the keyswitch is assembled, so that the third pivoting part and the first pivoting part are separated.

8. The support member of claim 1, wherein the first rotation structure is a shaft, and the second rotation structure is a shaft hole.

9. A keyswitch, comprising:

a base plate, comprising two first position structures disposed oppositely thereon;

a key cap, disposed above the base plate; and a support member, disposed between the base plate and the key cap for supporting the key cap to vertically move relative to the base plate, the support member comprising:

a first subunit, comprising a first arm, the first arm comprising a first rotation structure, a first pivoting part and a second pivoting part being bended to extend from two ends of the first arm respectively; and a second subunit, comprising a third pivoting part temporarily connected to the first pivoting part through a connection part, the connection part comprising a pre-cut portion, the connection part breaking at the pre-cut portion under a loading of an external force so that the third pivoting part and the first pivoting part are separated when the keyswitch is assembled, the second subunit further comprising a second arm and a third arm being bended to extend from two ends of the third pivoting part respectively, the second arm comprising a second rotation structure pivotally connected to the first rotation structure, wherein the second arm comprises a second position structure at an end thereof, the third arm comprises a third position structure at one end thereof corresponding to the second position structure, and a distance between the second position structure and the third position structure is longer than a distance between the two first position structures;

wherein when the keyswitch is assembled, the second pivoting part and the third pivoting part are movably connected to the key cap, the third pivoting part and the first pivoting part are separated, so that the first subunit and the second subunit are able to rotate relatively around an axis of the first rotation structure and the second rotation structure, the first pivoting part is movably connected to the base plate, and the second position structure and the third position structure are movably connected to the two first position structures respectively.

10. The keyswitch of claim 9, wherein the second subunit is made of resilient material.

11. The keyswitch of claim 10, wherein the resilient material is polyoxymethylene.

12. The keyswitch of claim 9, wherein the second subunit is U-shaped.

13. The keyswitch of claim 9, wherein the second arm comprises a first engagement part, the third comprises a second engagement part, and when the keyswitch is assembled, the first engagement part is engaged to the second engagement part firmly.

14. The keyswitch of claim 9, wherein the base plate comprises a protrusion for fracturing the connection part when the keyswitch is assembled, so that the third pivoting part and the first pivoting part are separated.

15. The keyswitch of claim 9, wherein the key cap comprises a protrusion for fracturing the connection part when the keyswitch is assembled, so that the third pivoting part and the first pivoting part are separated.

16. The keyswitch of claim 9, wherein the first rotation structure is a shaft, and the second rotation structure is a shaft hole.

17. A keyboard, comprising:

a base plate;

a plurality of key caps, disposed above the base plate; and a plurality of support members, disposed between the base plate and the key caps correspondingly for supporting the corresponding key cap to vertically move relative to the base plate, each of the support member comprising:

a first subunit, comprising a first arm, the first arm comprising a first rotation structure, a first pivoting part and a second pivoting part being bended to extend from two ends of the first arm respectively; and a second subunit, comprising a third pivoting part temporarily connected to the first pivoting part through a connection part, the connection part comprising a pre-cut portion, the connection part breaking at the pre-cut portion under a loading of an external force so that the third pivoting part and the first pivoting part are separated when the keyboard is assembled, the second subunit further comprising a second arm and a third arm being bended to extend from two ends of the third pivoting part respectively, the second arm comprising a second rotation structure pivotally connected to the first rotation structure, wherein the second arm comprises a second position structure at an end thereof, the third arm comprises a third position structure at one end thereof corresponding to the second position structure, and a distance between the second position structure and the third position structure is longer than a distance between the two first position structures;

wherein when the keyboard is assembled, the second pivoting part and the third pivoting part are movably connected to the key cap, the third pivoting part and the first pivoting part are separated, so that the first subunit and the second subunit are able to rotate relatively around an axis of the first rotation structure and the second rotation structure, the first pivoting part is movably connected to the base plate, and the second position structure and the third position structure are movably connected to the two first position structures respectively.

18. The keyboard of claim 17, wherein the second subunit is made of resilient material.

19. The keyboard of claim 18, wherein the resilient material is polyoxymethylene.

20. The keyboard of claim 17, wherein the second subunit is U-shaped.

21. The keyboard of claim 17, wherein the second arm comprises a first engagement part, the third comprises a second engagement part, and when the keyboard is assembled, the first engagement part is engaged to the second engagement part firmly.

22. The keyboard of claim 17, wherein the base plate comprises a protrusion for fracturing the connection part when the keyboard is assembled, so that the third pivoting part and the first pivoting part are separated.

23. The keyboard of claim 17, wherein the key cap comprises a protrusion for fracturing the connection part when the keyboard is assembled, so that the third pivoting part and the first pivoting part are separated.

24. The keyboard of claim 17, wherein the first rotation structure is a shaft, and the second rotation structure is a shaft hole.

* * * * *